US006288653B1

(12) United States Patent
Shih

(10) Patent No.: US 6,288,653 B1
(45) Date of Patent: Sep. 11, 2001

(54) CURVED SURFACE SIGNAL PICK-UP DEVICE

(76) Inventor: Yun Ning Shih, 3F, No. 1, Alley 7, Lane 39, Kuo-Tai St., Pan Chiao City, Taipei Hsien (TW)

( * ) Notice: Subject to any disclaimer, the term of this patent is extended or adjusted under 35 U.S.C. 154(b) by 0 days.

(21) Appl. No.: 09/217,891

(22) Filed: Dec. 22, 1998

(51) Int. Cl.[7] ..... H01H 19/58

(52) U.S. Cl. ..... 341/35; 341/20; 324/207.25; 324/207.23; 345/163; 200/110 A; 200/292

(58) Field of Search ..... 341/20, 35, 3, 341/11; 345/163, 164, 167; 324/207.11, 207.21, 207.22, 207.23, 207.25; 200/110 A, 292

(56) References Cited

U.S. PATENT DOCUMENTS 4,037,116 * 7/1977 Hodama ..... 200/11 DA
4,145,585 * 3/1979 Iwasaki ..... 200/11 DA
4,318,095 * 3/1982 Fukuoka ..... 340/706
4,443,670 * 4/1984 Nakamura ..... 200/11 DA
4,578,547 * 3/1986 Gunther et al. ..... 200/11 DA
4,591,674 * 5/1986 Rose ..... 200/11 DA
4,914,437 * 4/1990 Kilbrick ..... 341/3
5,418,341 * 5/1995 Sato ..... 200/11 DA
5,450,075 * 9/1995 Waddington ..... 341/35
6,140,916 * 10/2000 Stollsteimer ..... 340/456

* cited by examiner

*Primary Examiner*—Michael Horabik
*Assistant Examiner*—Albert K. Wong
(74) *Attorney, Agent, or Firm*—Rosenberg, Klein & Lee

(57) ABSTRACT

A curved surface signal pick-up device comprises a rotary disk and graphite brushes. The rotary disk has grid ring on the side thereof. The grid ring have a common portion and transferring portions spaced with equal or unequal distances, each of the transferring portions are arranged alternatively so that the common portion and transferring portions on the rotary disk are arranged on the same radius. Graphite brushes made by dividing an single located element, one end of the graphite brushes are connected on a circuit board for transferring the receiving different signals, while another end of the graphite brushes are contacted with the common portion and the transferring portions of the grid ring. While the rotary disk rotates, the graphite brushes will output signals of different voltages according to the variations of the alternative transferring portions are installed on the same radius, even if a slight variation of angle is occurred, the present invention can detect this variation, therefore, the resolution is improved. Besides, the graphite brushes are made by dividing a single located element. Accordingly, the difficulty in fabrication is reduced and the yield is increased.

2 Claims, 4 Drawing Sheets

IF COM=HIGH

| BIT | 0 | 1 | 2 | 3 |
|---|---|---|---|---|
| B | 0 | 1 | 1 | 0 |
| A | 1 | 1 | 0 | 0 |

IF COM=HIGH

| BIT | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| D | 0 | 1 | 1 | 0 | 0 | 1 | 1 | 0 | 0 | 1 | 1 | 0 | 0 | 1 | 1 | 0 |
| C | 0 | 0 | 1 | 1 | 1 | 1 | 0 | 0 | 0 | 0 | 1 | 1 | 1 | 1 | 0 | 0 |
| B | 0 | 0 | 0 | 0 | 1 | 1 | 1 | 1 | 1 | 1 | 1 | 1 | 0 | 0 | 0 | 0 |
| A | 0 | 0 | 0 | 0 | 0 | 0 | 0 | 0 | 1 | 1 | 1 | 1 | 1 | 1 | 1 | 1 |

CURVED SURFACE SIGNAL PICK-UP DEVICE

BACKGROUND OF THE INVENTION

1. Field of the Invention

The present invention relates to a curved surface signal pick-up device, wherein the graphic brushes are made from dividing a single located element, and the common portion and transferring portions are installed on the same radius, therefore, the rotation of a small angle can be detected, and thus the resolution is increase, 2. Description of the Prior Art In the prior art single grid device, which is generally used in a mechanic mouse, as shown in FIG. 4, includes a conducted rotary disk, and a grid ring 71 is installed on the surface of the rotary disk, an insulating portion formed on the middle of the grid ring 711. The grid ring 71 is installed with a transferring portion 712 surrounding the axial center of the rotary disk and having a strip, and further installed three graphite brushes 81, 82 and 83. One ends of the three graphite brushes 81, 82 and 83 are connected with one circuit board 84. Another ends thereof are contacted with the transferring portion 712 and the insulating portion 711. Therefore, as the rotary disk is rotated, the graphite brushes 81, 82 and 83 will output different voltages according to the locations of the transferring portions 712. Namely, signals of 0 and 1 are outputted for transferring to the central processing unit of a computer.

However, in the conventional single grid encoder, the transferring portion 712 and insulating portion 711 are installed in different radii. Therefore, when a slight rotation is occurred, the graphite brushes 81, 82 and 83 have different moving distances so that the voltage variations are effected. Therefore, the resolution can not be improved. Moreover, since the lengths and positions of the graphite brushes are different, thus the fabrication process is complicated and the cost is increased.

SUMMARY OF THE INVENTION

Accordingly, the object of the present invention is to provide a novel curved surface signal pick-up device, wherein the graphite brushes are made from dividing a single located element. The common portion and transferring portions are installed on the same radius, the rotation of a small angle can be detected, and thus the resolution is increase.

Accordingly, a curved surface signal pick-up device comprises a rotary disk and graphite brushes. The rotary disk has grid ring on the side thereof. The grid ring have a common portion and transferring portions spaced with equal or unequal distances, each of the transferring portions are arranged alternatively so that the common portion and transferring portions on the rotary disk are arranged on the same radius. Graphite brushes made by dividing an identical located element, one end of the graphite brushes are connected on a circuit board for transferring the receiving different signals, while another end of the graphite brushes are contacted with the common portion and the transferring portions of the grid ring. While the rotary disk rotates, the graphite brushes will output signals of different voltages according to the variations of the alternative transferring portions on the two sides thereof. Since the common portion and the transferring portions are installed on the same radius, even if a slight variation of angle is occurred, the present invention can detect this variation, therefore, the resolution is improved. Besides, the graphite brushes are made by dividing a single located element. Accordingly, the difficulty in fabrication is reduced and the yield is increased.

The present invention will be better understood and its numerous objects and advantages will become apparent to those skilled in the art by referencing to the following drawings in which:

DETAILED DESCRIPTION OF THE PREFERRED EMBODIMENT

Figure 1:
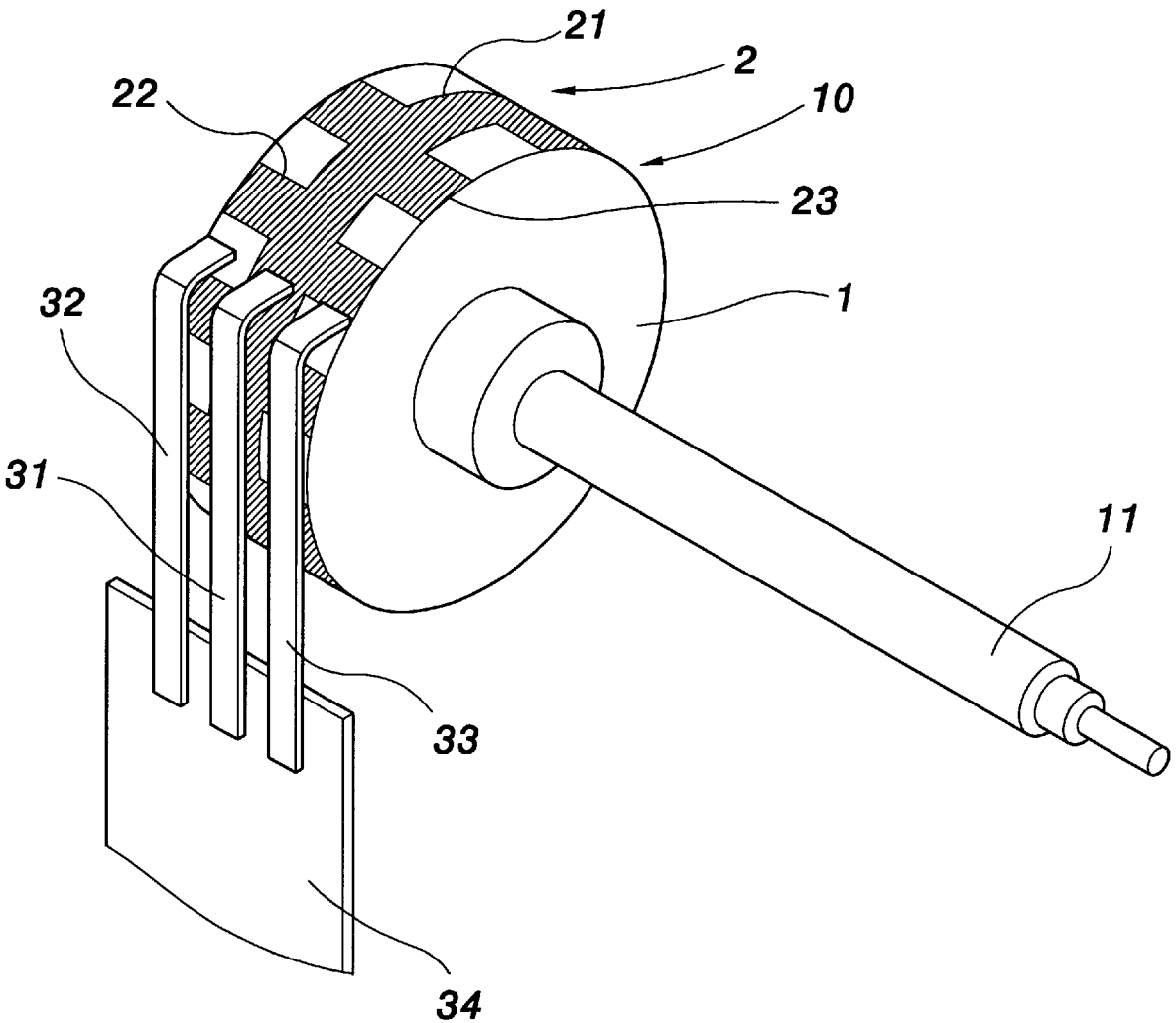
FIG. 1 is a schematic view showing the structure of the present invention.

Referring now to FIG. 1, in the referred embodiment of the present invention, the curved surface signal pick-up device 10 is employed in an encoder, especially in the encoder of a mechanical mouse. Of course, it also can be used in a microswitch. The curved surface signal pick-up device 10 of the present invention includes a rotary disk 1 connected with a rotary axis 11 so that as a rolling ball is rolling, the rotary disk will drive the rotary axis 11 to rotate in order that the rotary disk is rotated. A grid ring 2 is installed on the lateral side of the rotary disk 1. Of course, since the present embodiment is used in an encoder, thus the grid ring 2 is installed. If the present invention is employed in other devices, other pattern can be formed on the lateral side of the rotary disk 1. A common portion 21 is formed on the middle of the grid ring 2. Transferring portions 22 and 23 which are alternatively arranged with an equal space are installed on the two sides of the common position portion 21.

Figure 2:
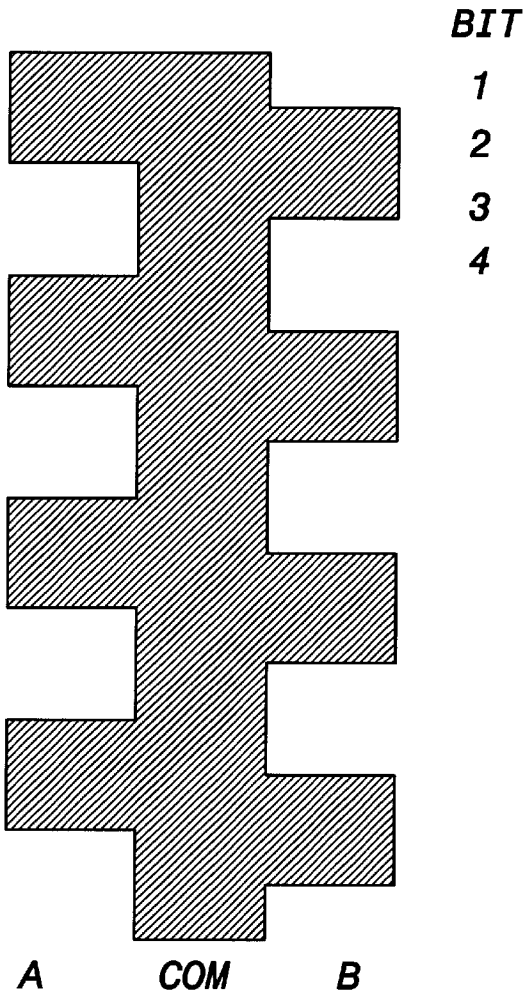
FIG. 2 is a look-up table showing a binary relative encoding in a encoder installed with the curved surface signal pick-up device of the present invention.
Figure 3:
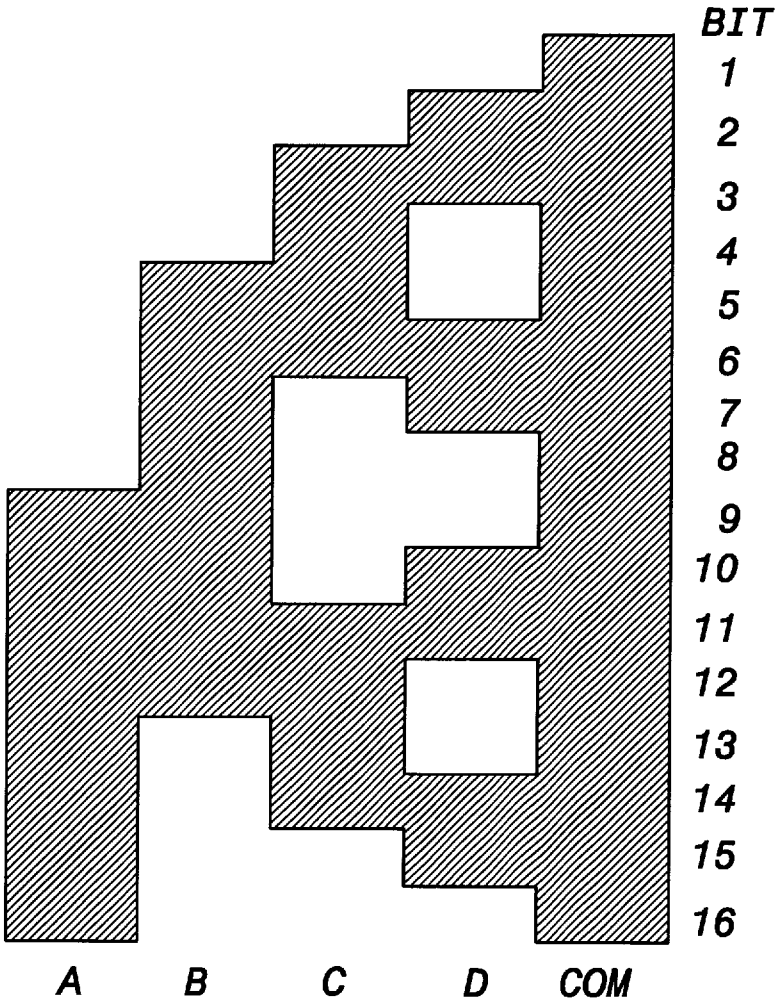
FIG. 3 is a look-up table showing a 4-bits absolute encoding in a encoder installed with the curved surface signal pick-up device of the present invention.
Figure 4:
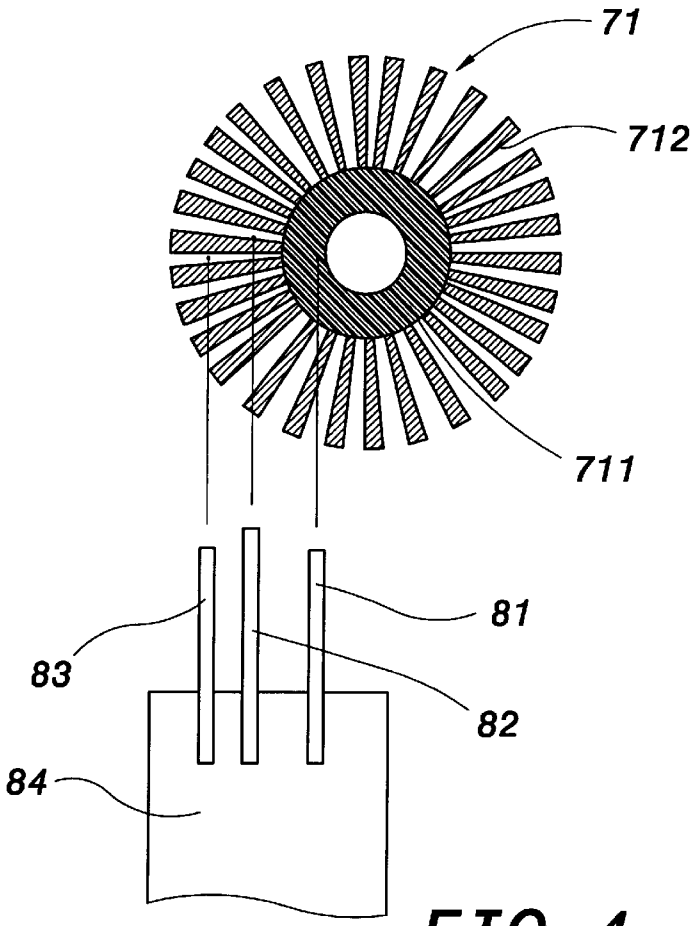
FIG. 4 PRIOR ART
FIG. 4 is a schematic view of a prior art single grid device utilized in an encoder.

Referring to FIG. 2, if the present embodiment is employed in an encoder having a binary relative encoding, the shape of the grid ring of the binary relative encoding is shown in FIG. 2. The common portions are installed on the middle portion and transferring portions A and B are installed on the two sides thereof for output different voltage signals, i.e. signals 0 and 1. The best embodiment of the present invention is a binary relative encoding. Referring now to FIG. 3 again, the encoder may be a 4 bits absolute encoding, and then the grid ring 2 is shown in FIG. 2, wherein a common portion (COM) and four transferring portions A, B, C, and D are installed in one side.

Referring to FIG. 1 again, in the present invention, at least three graphite brushes 31, 32, and 33 are installed. Since it is used in the binary relative encoding, thus three graphite brushes 31, 32 and 33 are installed. The three graphite brushes 31, 32 and 33 have equal lengths. Originally, they are made in the same element and the element is divided into three parts. One ends of the graphite brushes 31, 32 and 33 are connected in a circuit board 34 for outputting the receiving voltage signals. Another end of the graphite brush 31 is connected with the common portion 21 of the grid ring 2 for grounding. While another ends of the graphite brush 32 and 33 are contacted with the transferring portions 22 and 23 on the two sides of the grid ring 2.

In the present invention, as the rolling ball of the mouse is rolling, the rotary axis 11 will be driven to rotate so that the rotary disk 1 is also rotated. While the rotary disk 1 rotates, the graphite brushes 31, 32 and 33 will output signals of different voltages according to the variations of the alternative transferring portions on the two sides thereof. Then the different voltage signals are further send to the CPU (central processing unit) of a computer for moving a cursor.

In the present invention, since the common portion 21 of the grid ring 2 and the transferring portions 22 and 23 on the two sides thereof are arranged on the same radius, and thus, even if a slight variation of angle is occurred, the present invention can detect this variation, therefore, the resolution is improved. Besides, the graphite brushes 31, 32 and 33 are made from one element which is located and then is divided. Accordingly, the difficulty in fabrication is reduced. Therefore, the graphite brush of one specification is necessary in fabrication. This simplifies the fabrication process and reduces the cost.

In summary, the curved surface signal pick-up device of the present invention has improved many defects in prior art and is substantially a novel invention. Although the present invention has been described using specified embodiment, the examples are meant to be illustrative and not restrictive. It is clear that many other variations would be possible without departing from the basic approach, demonstrated in the present invention. Therefore, all such variations are intended to be embraced within the scope of the invention as defined in the appended claims.

DESCRIPTION OF THE NUMERAL IN FIGURES

10 Curved surfaces signal pick-up device
1 Rotary disk
11 Rotary axis
2 Grid ring
21 Common portion
22, 23 Transferring portion
32, 32, 33 Graphite brush

What is claimed is:

1. A curved surface signal pick-up device comprising:

a rotary disk having a grid ring on the radial side, the grid ring including a common portion and transferring portions with the same radius, the transferring portions having spaced contact points and wherein the transfer portions and the common portion are arranged alternatively; and a single located element divided into graphite brushes on one end, the graphite brushes in contact with the grid ring to generate signals; the second end of the located element connected to a circuit board for transferring the signals.

2. A mechanical mouse comprising:

an encoder wherein the encoder includes the signal pick-up device in claim 1.

* * * * *